US009745790B2

(12) United States Patent
Norwood

(10) Patent No.: US 9,745,790 B2
(45) Date of Patent: Aug. 29, 2017

(54) PREFABRICATED FLASHING PRODUCT

(71) Applicant: Norwood Architecture, Inc., Louisville, CO (US)

(72) Inventor: Steven A. Norwood, Louisville, CO (US)

(73) Assignee: Norwood Architecture, Inc., Louisville, CO (US)

( * ) Notice: Subject to any disclaimer, the term of this patent is extended or adjusted under 35 U.S.C. 154(b) by 0 days.

(21) Appl. No.: 14/746,809

(22) Filed: Jun. 22, 2015

(65) Prior Publication Data

US 2015/0292195 A1 Oct. 15, 2015

Related U.S. Application Data

(63) Continuation-in-part of application No. 14/479,282, filed on Sep. 6, 2014, which is a continuation-in-part
(Continued)

(51) Int. Cl.
*E04D 13/00* (2006.01)
*E06B 1/62* (2006.01)
(Continued)

(52) U.S. Cl.
CPC ..... *E06B 1/62* (2013.01); *E04D 13/00* (2013.01); *E04D 13/0459* (2013.01); *E06B 7/14* (2013.01); *E06B 2001/628* (2013.01)

(58) Field of Classification Search
CPC ..... E04B 1/62; E04B 1/68; E04B 1/66; E04B 1/665; E04D 13/00; E04D 13/0459;
(Continued)

(56) References Cited

U.S. PATENT DOCUMENTS

RE24,027 E 6/1955 Bourne et al.
2,822,763 A 2/1958 Berg
(Continued)

FOREIGN PATENT DOCUMENTS

CA 2292301 1/2001
WO 2004055293 A1 7/2004

OTHER PUBLICATIONS

U.S. Appl. No. 14/628,714 Final Rejection dated Nov. 17, 2015, 24 pages.

(Continued)

*Primary Examiner* — Phi A
(74) *Attorney, Agent, or Firm* — Lathrop & Gage LLP

(57) ABSTRACT

A flashing product is manufactured by creating a reinforcing member having a flange shaped to conform to the exterior surface. The flange may extend outwardly from an entire perimeter of an aperture in the reinforcing member. The flange may have top, bottom, and side flange members. The reinforcing member may include a return having top, bottom and side return members connected respectively to the top, bottom and side flange members. The return may extend substantially perpendicularly from the flange to conform to an inward direction of an opening where the flashing product is applied. The reinforcing member may be coated with a waterproof material thereby forming a waterproof flashing product.

7 Claims, 13 Drawing Sheets

Related U.S. Application Data of application No. 13/572,274, filed on Aug. 10, 2012, now Pat. No. 8,959,842.

(51) Int. Cl.
*E06B 7/14* (2006.01)
*E04D 13/04* (2006.01)

(58) Field of Classification Search
CPC ..... E04D 2013/0813; E04D 13/002; E04D 13/15; E06B 1/62; E06B 7/14; E04F 13/00; E04F 13/002; E04F 13/07; E04F 13/007
See application file for complete search history.

(56) References Cited

U.S. PATENT DOCUMENTS 2,974,448 A 3/1961 Weis
3,139,702 A * 7/1964 Wasserman ..... E04D 13/0305 49/DIG. 1
3,416,271 A 12/1968 Heeney
4,361,331 A 11/1982 Kohler
4,387,900 A 6/1983 Ditcher
4,543,753 A 10/1985 Sonneborn et al.
4,621,466 A 11/1986 Sonneborn et al.
4,663,885 A * 5/1987 Stibolt ..... E06B 9/04 49/379
4,694,612 A 9/1987 Pruden et al.
4,776,141 A * 10/1988 Powell ..... E04D 13/0354 52/200
4,873,803 A 10/1989 Rundo
4,966,374 A 10/1990 Oikawa
4,972,638 A 11/1990 Minter
4,972,639 A 11/1990 Woznick
5,018,333 A 5/1991 Bruhm
5,029,879 A 7/1991 Strang, Sr.
5,065,553 A 11/1991 Magid
5,526,619 A * 6/1996 Vagedes ..... E03B 9/00 248/56
5,586,415 A 12/1996 Fisher et al.
5,675,940 A * 10/1997 Bahar ..... E04D 13/1475 52/200
D397,810 S 9/1998 Basset
5,832,675 A * 11/1998 Zuares ..... E04H 12/2292 52/170
5,899,026 A 5/1999 Williams et al.
5,946,870 A 9/1999 Bifano et al.
6,212,834 B1 4/2001 Lindgren
D448,095 S 9/2001 Merideth
6,293,064 B1 9/2001 Larson
6,305,130 B1 10/2001 Ackerman, Jr.
6,385,925 B1 5/2002 Wark
6,401,401 B1 6/2002 Williams
6,401,402 B1 * 6/2002 Williams ..... E06B 1/62 49/471
6,457,279 B1 10/2002 Jacobsen et al.
6,526,709 B1 3/2003 Jacobsen
6,584,746 B1 * 7/2003 Hohmann ..... B32B 25/10 428/295.1
6,640,508 B2 11/2003 Lindgren et al.
6,725,610 B2 4/2004 Murphy et al.
6,981,348 B2 * 1/2006 Kjorsvik ..... E04F 19/02 52/211
7,158,034 B2 1/2007 Corbett, Jr.
7,222,462 B2 5/2007 Ellingson
7,331,145 B2 2/2008 Feucht et al.
7,408,111 B2 8/2008 Clark
7,563,980 B2 7/2009 Wimberly
7,591,106 B2 9/2009 Conlin
7,673,426 B2 3/2010 Broad et al.
7,676,996 B2 3/2010 Teodorovich
7,775,004 B2 8/2010 Allen
7,797,884 B2 9/2010 Allen
7,874,121 B1 1/2011 Hohmann, Jr.
7,877,940 B2 2/2011 Meeks et al.
7,877,945 B2 2/2011 Eggen et al.
7,937,900 B1 5/2011 Gaffney et al.
8,006,445 B2 8/2011 Burton et al.
8,015,756 B2 * 9/2011 Bonshor ..... E06B 1/62 248/205.1
8,065,839 B2 11/2011 Conlin
8,387,336 B2 3/2013 Coulton et al.
8,393,120 B2 3/2013 Valentz
D684,280 S 6/2013 Moore
8,561,357 B2 10/2013 Teodorovich
D697,640 S 1/2014 Ksiezopolski
8,678,399 B2 * 3/2014 Knapp ..... F16L 25/0054 277/644
8,683,695 B2 4/2014 Rasmussen et al.
8,959,842 B2 2/2015 Norwood et al.
2002/0108326 A1 8/2002 Ackerman, Jr.
2003/0056444 A1 3/2003 Ackerman, Jr.
2003/0177712 A1 9/2003 Gatherum
2004/0041347 A1 3/2004 Beach
2004/0163330 A1 8/2004 Crum
2005/0144865 A1 7/2005 Ellingson
2005/0166471 A1 8/2005 Allen
2006/0010788 A1 1/2006 Nettleton
2006/0130426 A1 6/2006 O'Rourke et al.
2006/0236618 A1 10/2006 Williams
2006/0260216 A1 11/2006 Bonshor
2008/0178557 A1 7/2008 Parsons et al.
2008/0229676 A1 9/2008 Allen
2009/0056241 A1 3/2009 Koessler et al.
2010/0139178 A1 6/2010 Ehrman et al.
2010/0251643 A1 10/2010 Rosende et al.
2011/0047888 A1 3/2011 Bonshor
2011/0072747 A1 3/2011 Tatley et al.
2012/0144761 A1 6/2012 Teodorovich
2012/0255250 A1 * 10/2012 Wetmore ..... E04B 1/644 52/302.6
2014/0250801 A1 * 9/2014 Knollmeyer ..... E06B 1/62 52/58

OTHER PUBLICATIONS

U.S. Appl. No. 29/501,163, Notice of Allowance dated Sep. 15, 2015, 28 pages.
U.S. Appl. No. 29/429,452.
U.S. Appl. No. 13/572,274 Office Action dated Sep. 18, 2014, 8 pages.
U.S. Appl. No. 13/572,274 Response dated Oct. 20, 2014, 13 pages.
U.S. Appl. No. 13/572,274 Notice of Allowance dated Oct. 29, 2014, 5 pages.
Chinese Patent Application 201310347255.0 Office Action dated Jan. 4, 2016 with Concise Explanation, 11 pages.
U.S. Appl. No. 14/479,282 Final Office Action dated Feb. 1, 2016, 11 pages.
U.S. Appl. No. 14/628,714 Final Rejection dated Nov. 17, 2015, 9 pages.
Dryvit AquaFlash System Installation Guide DS196, retrieved from http://www.dryvit.com/residential/products_list.asp?type=4, dated Mar. 3, 2009, 5 pages.
Dryvit Backstop NT and AquaFlash D5268, retrieved from http://www.dryvit.com/residential/products_list.asp?type=4, dated 2014, 4 pages.
Dryvit Flashing Tape, Flashing Tape Surface Conditioner and Grid Tape DS450, retrieved from http://www.dryvit.com/residential/products_list.asp?type=4 on, dated Apr. 30, 2015, 3 pages.
Dryvit AquaFlash System DSC494, retrieved from http://www.dryvit.com/residential/product_list.asp?type=4, dated 2008, 2 pages.
Dryvit Safety Data Sheet SDS1294, retrieved from http://www.dryvit.com/residential/products_list.asp?type=4, dated May 22, 2015, 3 pages.
Dryvit AquaFlash and Backstop NT, AF BS NT, retrieved from http://www.dryvit.com/residential/products_list.asp?type=4, dated 2010, 2 pages.

(56) References Cited

OTHER PUBLICATIONS

Quickflash Weatherproofing Products, Home Constructions Equipment, Toxic Mold Prevention: Retrieved from the Internet at http://www.quickflashproducts.com/products_eletrical.html on Jun. 20, 2012.
U.S. Appl. No. 29/429,452 Notice of Allowance dated May 27, 2014, 8 pages.
U.S. Appl. No. 13/472,274 Select File History dated Aug. 10, 2012 through Oct. 29, 2014, 82 pages.
U.S. Appl. No. 14/228,590 Office Action dated Jan. 12, 2015, 26 pages.
Mexican Patent Application MXa2013009322 Office Action dated Jul. 3, 2015, 2 pages.
Chinese Patent Application 201310347255.0 Office Action dated Apr. 29, 2015, 14 pages.
U.S. Appl. No. 14/228,590 Notice of Allowance dated Jul. 20, 2015, 7 pages.
U.S. Appl. No. 14/628,714 Non-final Office Action dated Apr. 30, 2015, 10 pages.
U.S. Appl. No. 14/479,282, Non-Final Rejection dated Jul. 22, 2016, 7 pp.
U.S. Appl. No. 14/628,714, Non-Final Rejection dated Aug. 24, 2016, 11 pp.
Chinese Patent Application No. 201310347255.0, Office Action dated Jun. 2, 2016, 13 pp.

* cited by examiner

PREFABRICATED FLASHING PRODUCT

RELATED APPLICATIONS

This application is a continuation-in-part of U.S. patent application Ser. No. 14/479,282, titled "Prefabricated Flashing Product", and filed Sep. 6, 2014, which is a continuation-in-part of U.S. patent application Ser. No. 13/572,274, titled "Prefabricated Flashing Product", and filed Aug. 10, 2012. Each of the aforementioned applications are incorporated by reference in their entireties.

BACKGROUND

A common failure mode in construction is a failure to form a durable weatherproof assembly at features such as doors and windows installed within openings of exterior surfaces. Various types of flashing products have been developed, some of which use field-applied strips of adhesive backed sheet products. Other products are field-assembled to flash a portion of an opening, typically the sill or bottom of an opening. These other products help to prevent moisture ingress around such features, but are inherently susceptible to failure, or can become susceptible to failure through improper installation.

SUMMARY

In an embodiment, an expandable fenestration flashing product for sealing an entire boarder of a fenestration at an exterior surface of a structure and an internal surface of the fenestration, the expandable fenestration flashing product includes a generally planar, unitary flashing having an outer dimension and an aperture defined by and inner dimension formed of an expandable, water proof material. The expandable fenestration flashing product is configured to be fixed to the exterior surface and at least a portion of the expandable fenestration flashing product is configured to be secured to an inner surface of the fenestration.

In an embodiment, an expandable fenestration flashing product for sealing an entire boarder of a fenestration at an exterior surface of a structure and an internal surface of the fenestration, the expandable fenestration flashing product includes a generally planar, unitary flashing having an outer dimension and an aperture defined by and inner dimension formed of an expandable, water proof material. The expandable fenestration flashing product affixes to the exterior surface and at least a portion of the expandable fenestration flashing product secures to an inner surface of the fenestration.

In an embodiment, a method of integrating an expandable fenestration flashing product into an opening of an exterior surface of a structure includes securing at least a portion of the a expandable fenestration flashing product on to the an exterior surface of a structure about the opening and pressing a portion of the expandable fenestration flashing product into the fenestration. After pressing the flashing product into the fenestration, the portion of the expandable fenestration flashing product secures to an interior surface of the fenestration. If the back of the expandable fenestration flashing product includes an adhesive backing, securing includes applying pressure onto the expandable fenestration flashing product to adhere the flashing product to an inner surface of the opening.

DETAILED DESCRIPTION OF THE DRAWINGS

Figure 1:
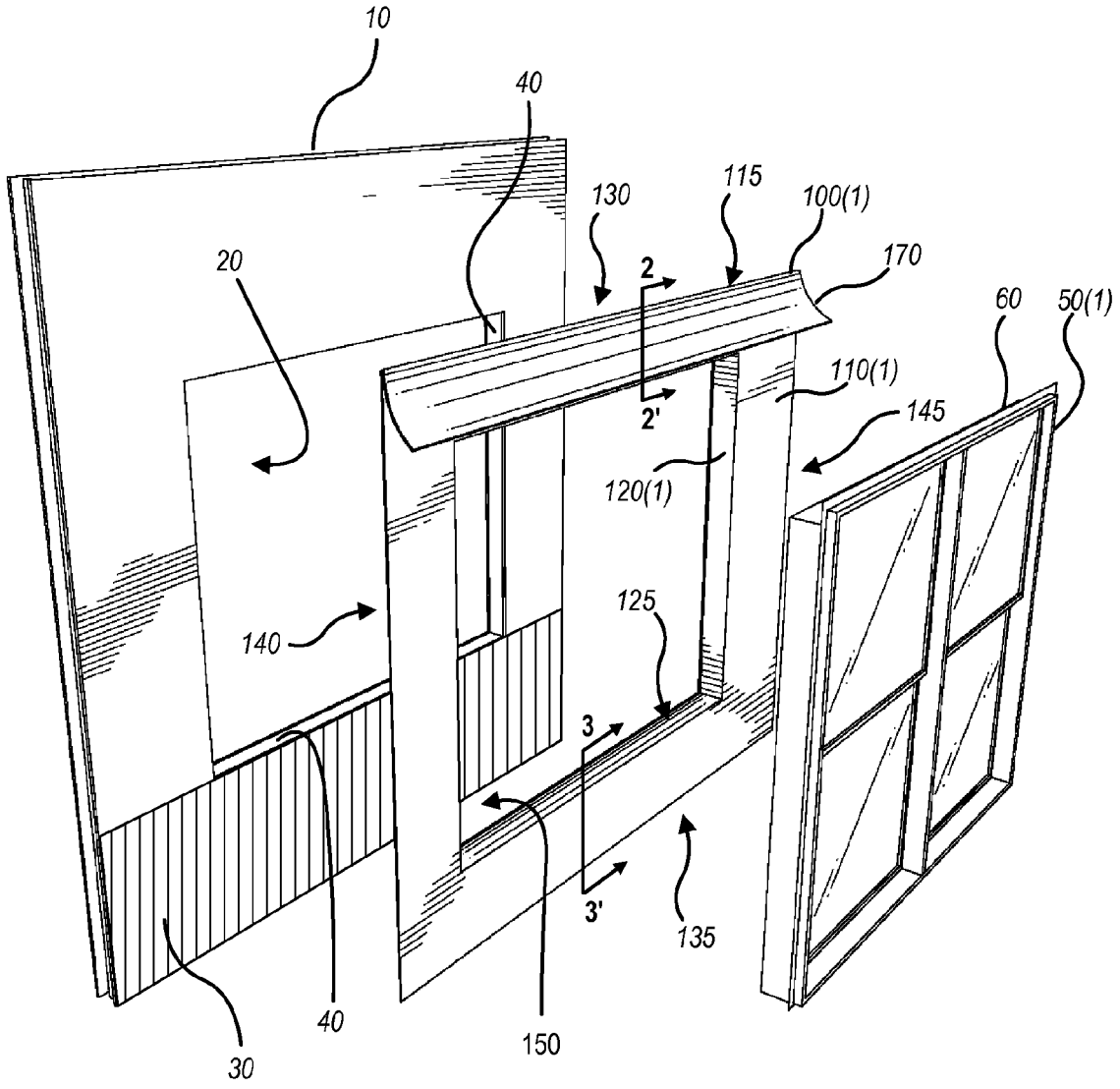
FIG. 1 is an exploded drawing that shows a prefabricated flashing product between a structure that forms an opening, and a window to be installed within the opening, in accord with an embodiment.

The present disclosure may be understood by reference to the following detailed description taken in conjunction with the drawings briefly described below. It is noted that, for purposes of illustrative clarity, certain elements in the drawings may not be drawn to scale. In particular, the thicknesses of many elements shown in certain drawings herein may be exaggerated in comparison to their height and width. Specific instances of an item may be referred to by use of a numeral in parentheses (e.g., flange 110(1), 110(2), etc.) while numerals without parentheses refer to any such item (e.g., flanges 110).

The following terms are utilized throughout the present application with the meanings given here. "Upwardly" and "downwardly" mean against and towards the direction of Earth's gravity respectively; "top" and "bottom" mean structure uppermost and lowermost with respect to Earth's gravity. A "slope" or "sloped" similarly refer to a surface that is not horizontal with respect to Earth's gravity. An "exterior surface" of a structure means a surface that is exposed to the elements (e.g., rain or snow); "outwardly" from such surface means away from the surface towards the elements, while "inwardly" from such surface means the direction through the surface, away from the elements.

Figure 7:
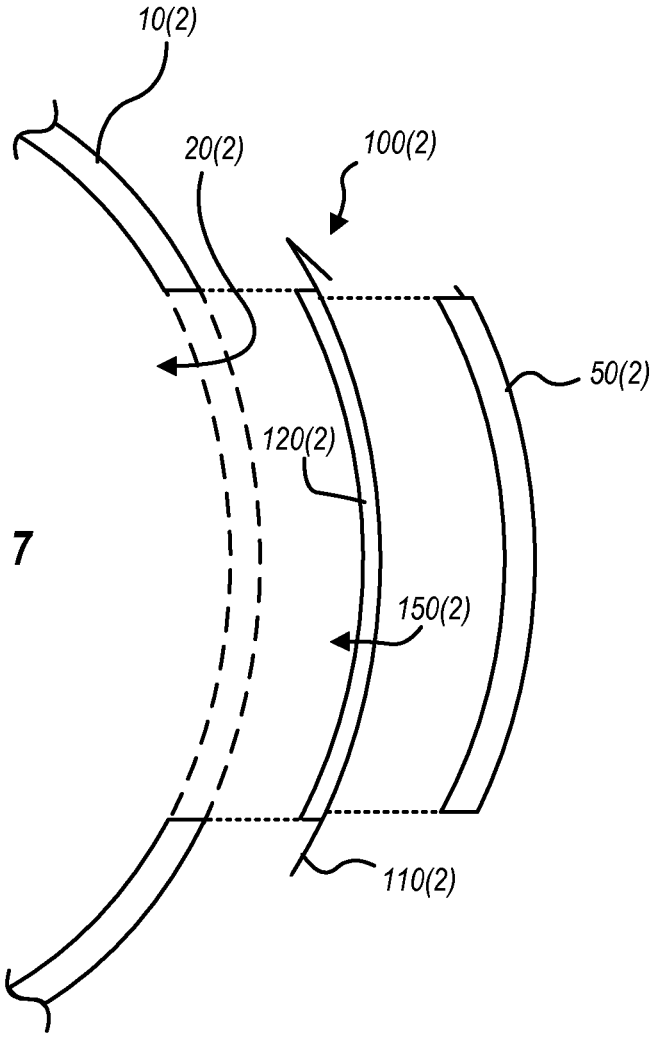
FIG. 7 is a schematic cross-section illustrating a prefabricated flashing product having a curved shape adapted for use with a structure having a curved exterior surface, and with a curved fenestration product, according to an embodiment.

"Outwardly from an aperture" refers to a flat or curved planar shape that extends away from the aperture in all directions, such as flange 110(1) extends from aperture 150 in FIG. 1 and flange 110(2) extends from aperture 150(2) in FIG. 7. "Into the direction of an opening" refers to the direction through an opening in an exterior surface that is from the outside of the surface, through the surface, toward the inside.

Fenestration is an architectural term of art that generally refers to an opening in a surface of a structure. A "fenestration product" as utilized herein is a product that extends through an exterior surface of a structure; framed windows, framed doors and skylights are examples of fenestration products.

FIG. 1 is an exploded drawing that shows a prefabricated flashing product 100(1) between an exterior surface 10 of a structure that forms an opening 20, and a window product 50(1) to be installed within opening 20. It is understood that window product 50(1) is exemplary only, and can be replaced by a different fenestration product. Typically before flashing product 100(1) is installed, a lower weather resistant barrier 30 is installed, but certain embodiments may omit lower weather resistant barrier 30 and install flashing product 100(1) directly on exterior surface 10. Opening 20 is usually surrounded by framing 40, as shown. Flashing product 100(1) includes a flange 110(1) and a return 120(1). Flashing product 100(1) is generally rectangular and has a top member 130, a bottom member 135, and left and right side members 140 and 145, although as discussed later herein, other embodiments of prefabricated flashing products may not be rectangular and accordingly may not have the same arrangement of top, bottom and side members as shown in FIG. 1. Flange 110(1) is planar, is shaped to conform to surface 10, and extends outwardly from an entire perimeter of an aperture 150 formed by flashing product 100(1), as shown.

Flashing product 100(1) is monolithically formed, typically by molding a rubber or plastic into the configuration disclosed herein. Because of its monolithic structure, return 120(1) of product 100(1) seals to flange 110(1) about aperture 150. Return 120(1) extends substantially perpendicularly and inwardly from aperture 150, that is, into the direction of opening 20. Thus, when return 120(1) of product 100(1) inserts into opening 20, flange 110(1) conforms to surface 10, such that if a weather resistant barrier (not shown; see FIG. 11B) is installed over top member 130 and side members 140, 145 after installation of prefabricated flashing product 100(1), product 100(1) will provide continuous flashing everywhere about opening 20 except for aperture 150 within product 100(1). Thus, any moisture that enters around edges of fenestration product 50(1) is still not able to access opening 20, but is diverted by flange 110(1) outwardly from opening 20 where it will likely not be able to continue ingress into the structure. In particular, the monolithic construction of flashing product 100(1) provides the advantage that the flashing product does not present a leakage risk around corners of fenestration products such as window 50(1). As noted above, certain prior art flashing products exist, such as field-applied strips of adhesive backed sheet products, or products that are field-assembled to flash a portion of an opening. Such products are commonly installed in overlapping fashion with one another or with custom corner pieces to form flashing about a window, but the overlap joints can present weaknesses, particularly over time as a structure ages. Embodiments herein avoid this issue, due to their monolithic construction.

Figure 2:
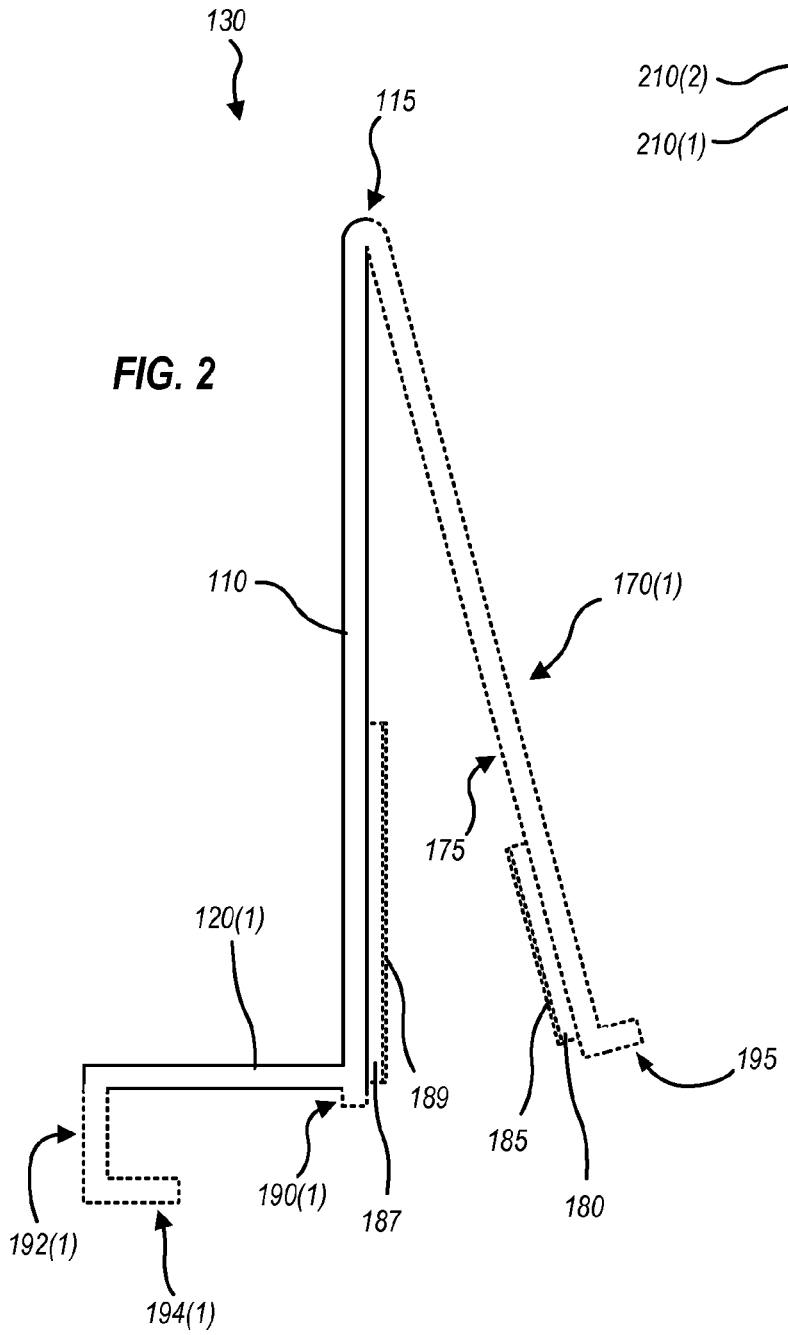
FIG. 2 is a schematic cross-section of a top member of the prefabricated flashing product of FIG. 1, according to an embodiment.

In certain embodiments, a return 120 forms a bottom interior surface 125 that slopes from a distal edge of return 120 (e.g., an edge of return 120 that is furthest from flange 110(1)) towards aperture 150). As shown in FIG. 2, sloping bottom interior surface 125(1) drains water on return 120(1) outwardly through aperture 150; in alternate embodiments, surface 125(1) may be flat (e.g., unsloped). Also, when surface 125 is sloped, return 120 may include ribs (see, e.g., FIG. 3) to form a flat surface for a fenestration product (e.g., window product 50(1)) to rest upon, at least during installation, without interfering with the ability of surface 125(1) to drain water outwardly through aperture 150.

Product 100(1) also includes an optional upper flap 170 that seals to an upper edge 115 of flange 110(1). Upper flap 170 typically folds down from upper edge 115 along a living hinge that may be formed (a) by folding over upper flap 170 along upper edge 115 or (b) at a molded-in indentation at upper edge 115. Upper flap 170 is designed to fold over, and optionally seal to, a nailing fin 60 of window product 50(1), as discussed further below (see, e.g., FIG. 6). Alternative embodiments herein do not include optional upper flap 170 (see, e.g., FIG. 12).

Prefabricated flashing product 100(1) is installed by insertion into an opening in an unfinished exterior surface, insertion of a fenestration product into aperture 150 of product 100(1), and folding optional upper flap 170 over a nailing fin of the fenestration product. Installed in this way, product 100(1) forms a wide, weatherproof boundary around the original opening. A weather resistant barrier (see FIG. 11B) is typically installed over flange 110(1) and upper flap 170. Optional installation steps include sealing flashing product 100(1) to the exterior surface that surrounds opening 20, nailing the flashing product into the exterior surface and/or into framing 40 about opening 20, sealing optional upper flap 170 to the nailing fin and/or to flange 110(1) where it folds over, and nailing upper flap 170 and/or flange 110(1) to the exterior surface. The installation process is disclosed in greater detail below in connection with FIG. 4.

As noted above, a flange 110 and a return 120 (and when present, optional upper flap 170) are monolithically formed of a waterproof material such as plastic or rubber to form product 100. In certain embodiments, a single waterproof material is the only material forming product 100; in alternate embodiments, the waterproof material may be molded about an inner material (e.g., a metal frame) for increased mechanical strength (see, e.g., FIG. 5).

Product 100, including flange 110 and return 120, may be fabricated of a size and thickness that is appropriate for a given installation. In the example of FIG. 1, a typical thickness of flange 110(1) and return 120 is about 30 mils (0.030 inches); in a lightweight version of product 100 this thickness could be as little as 20 mils and in a heavy duty version it could be 100 mils or more. For a typical installation (e.g., for a window that is 2 to 4 feet per side), flange 110(1) extends about 9 inches outwardly in all directions from the window opening. In smaller or larger installations, flange 110(1) may extend outwardly as little as about 4 inches, or as much as 12 inches or more. When present, optional upper flap 170 typically extends from upper edge 115 down to aperture 150, but for certain fenestration products having an exterior surface designed to butt up against the exterior surface, upper flap 170 may be shorter, so as to seal to a nailing fin of the window while lying flat against flange 110(1) (e.g., to avoid upper flap 170 pushing back from the edge of the fenestration product). Return 120 is typically less deep than a corresponding depth of framing used to construct a structure, but deeper than a fenestration product to be installed. For example, when 2×4 inch framing is utilized, return 120 may be about 3 inches deep, and a fenestration product may be about 2.5 inches deep. When 2×6 framing is utilized, return 120 may be about 5 inches deep.

FIG. 2 is a schematic cross-section of top member 130 taken along line 2-2' in FIG. 1. In this embodiment, return 120 is monolithically formed with flange 110(1), as shown. In the embodiment shown in FIG. 2, optional upper flap 170(1) is also monolithically formed with flange 110(1); that is, upper flap 170(1) is molded concurrently with flange 110(1) as an extension thereof. In other embodiments, an upper flap 170 may be formed separately from a flange 110 and sealed thereto along upper edge 115. After flashing product 100(1) is placed in an opening and a fenestration product is installed, upper flap 170(1) folds down along upper edge 115 and optionally seals to a nailing fin of the fenestration product (e.g., nailing fin 60 of window 50(1), FIG. 1 and FIG. 6) using adhesive strips, as now discussed.

FIG. 2 shows an optional adhesive strip 180 disposed along an inner surface 175 of upper flap 170(1). Adhesive strip 180 may be utilized to seal upper flap 170(1) to flange 110(1) and/or to a nailing fin of a window installed therein, as described further below. Adhesive strip 180 may be of any suitable thickness, for example 20 to 50 mils. Adhesive strip 180 may also have any suitable width; in certain embodiments strip 180 may be as wide as an upper flap 170, while in other embodiments it may be only one-half to two inches wide. Adhesive strip 180 may be positioned at the bottom of upper flap 170(1) or slightly above the bottom of upper flap 170(1), as shown in FIG. 2. Adhesive strip 180 may include a self-healing adhesive so that strip 180 can maintain a seal after being penetrated by a fastener (e.g., a nail, staple or screw). In the embodiment shown in FIG. 2, a release paper 185 is also shown. Release paper 185 preserves the adhesion of adhesive strip 180 until product 100(1) is installed, as described further below.

Another optional adhesive strip 187 and associated release paper 189 may also be disposed on flange 110(1), as shown. Adhesive strip 187 may be utilized to seal flange 110(1) to upper flap 170(1) and/or to an inner surface of a nailing fin of a fenestration product installed therein, as described further below. Adhesive strip 187 may also include a self-healing adhesive so that strip 187 can maintain a seal after being penetrated by a fastener, (e.g., a nail or screw).

Also shown in FIG. 2 are optional drip margins 190(1) and 195, an optional end dam 192(1) and optional return channel 194(1). Although moisture should not be present along the lower edge of top member 130(1) after installation, optional drip margin 190(1) serves as a backup to keep any liquid moisture that may be present in this area from running back along return 120(1), to further discourage ingress of moisture. Drip margin 190(1), end dam 192(1) and return channel 194(1) are particularly advantageous in installations of fenestration products that lack a nailing fin; for example, see FIG. 13. Drip margin 195 may be exposed to weather and helps to shed moisture thereon further away from the flashed opening than if drip margin 195 is not present.

Figure 3:
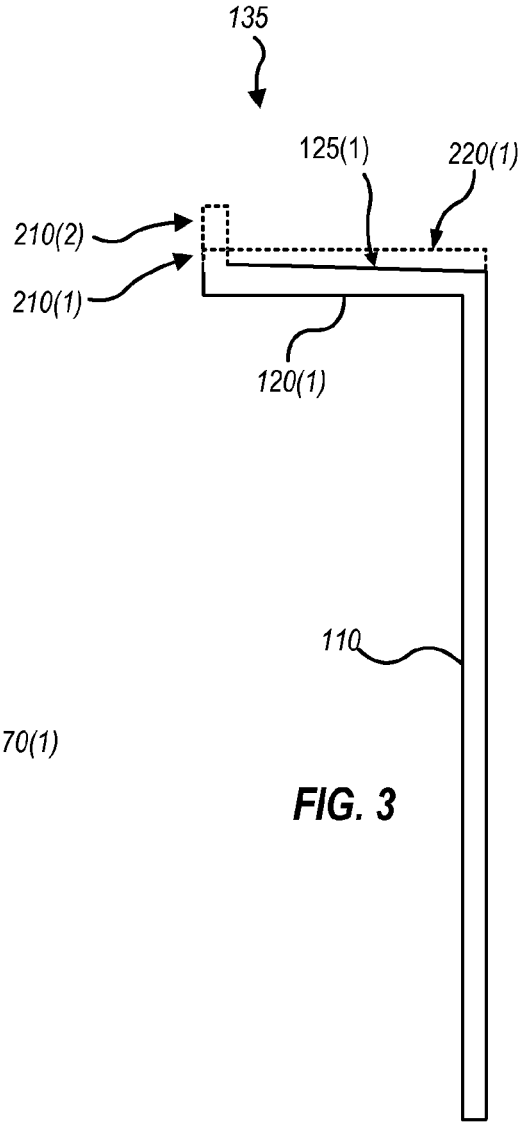
FIG. 3 is a schematic cross-section of a bottom member of the prefabricated flashing product of FIG. 1, according to an embodiment.

FIG. 3 is a schematic cross-section of bottom member 135 taken along line 3-3' in FIG. 1. In the embodiment of this figure, return 120(1) is monolithically formed with flange 110(1), as shown. A bottom interior surface 125 may be flat (unsloped) or may slope towards a flange 110, as bottom interior surface 125(1) is shown, so that any liquid moisture on surface 125(1) is urged towards flange 110(1) (e.g., towards aperture 150, see FIG. 1). An appropriate slope for surface 125(1) is from zero (unsloped) to about 0.25 inch per foot. When interior surface 125(1) surface is sloped, bottom member 135 may include optional ribs 220 that extend upwardly from surface 125(1). Ribs 220 form a flat (unsloped) surface that provides even support for a fenestration product with a flat bottom surface, at least during installation. (A typical installation that utilizes the flashing products described herein attaches the fenestration product to its associated structure utilizing conventional techniques and materials that support the weight of the fenestration product, in addition to the flashing product.) Ribs 220 may be between 0.25 and 1.0 inches wide, with spaces therebetween of 0.25 and 2.0 inches. Alternatively, when an interior surface 125 is flat (unsloped), surface 125 need not include ribs 220. Return 120(1) may also include an optional return stop 210. FIG. 3 shows two possible versions of return stop 210; return stop 210(1) is about 0.25 inch in height above surface 125(1) (that is, about level with optional ribs 220), while return stop 210(2) is about 1 inch in height above surface 125. Return stop 210 blocks liquid moisture that makes its way into return 120(1), from ingress towards the structure.

Figure 4:
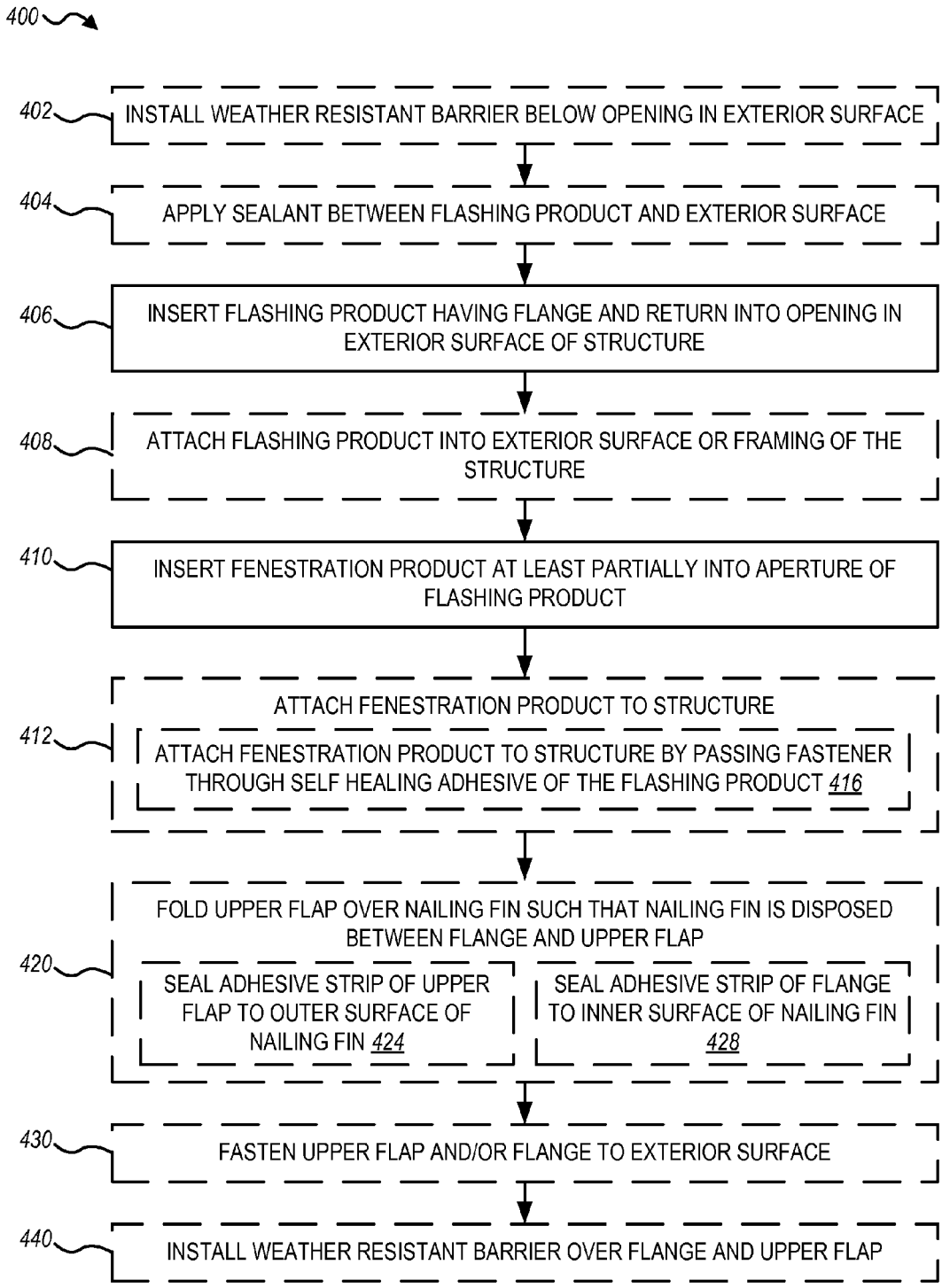
FIG. 4 is a flowchart that schematically illustrates a method of integrating a fenestration product into an opening of an exterior surface of a structure, according to an embodiment.

FIG. 4 is a flowchart that schematically illustrates a method 400 of integrating a fenestration product into an opening of an exterior surface of a structure. Step 402 of method 400 installs a weather resistant barrier below the opening. An example of step 402 is installing weather resistant barrier 30 below opening 20, FIG. 1. An optional step 404 applies a sealant between the flashing product and the exterior surface. An example of step 404 is applying a sealant around opening 20, FIG. 1, or utilizing an adhesive such as adhesive strip 560 on a rearwardly facing surface of flange 110(4), FIG. 9B. Step 406 of method 400 inserts a flashing product having at least a flange and a return into the opening. An example of step 406 is inserting prefabricated flashing product 100(1) into opening 20 of surface 10, FIG. 1. Step 404 may be performed either before or during step 406 (e.g., the flashing product may be inserted partially into the opening as per step 404, a release paper may be removed from adhesive strip 560 as per step 406, and the flashing product may then be fully inserted into the opening to complete step 404). Another optional step 408 attaches the flashing product into the exterior surface or into framing of the structure. Nails are typically utilized in step 408, but other fasteners such as screws may be utilized. An example of step 408 is nailing product 100(1) into framing 40, FIG.

1. Alternatively, step 408 may be omitted, for example, when the flashing product matches dimensions of the opening into which it is installed such that the fenestration product and/or its attachment within the opening will be sufficient to hold the flashing product in place.

Step 410 inserts the fenestration product at least partially into the aperture of the flashing product. An example of step 410 is inserting window product 50(1) into flashing product 100(1), FIG. 1. It is appreciated that the fenestration product may not and usually will not be inserted completely into the aperture. For example, a nailing fin or other features of the fenestration product may not be inserted into the flashing product, but may remain outside the aperture (e.g., abutting flange 110, see FIG. 6). Similarly, in certain embodiments the fenestration product may only extend part way into the return of the flashing product (e.g., the fenestration product may be inserted until a rear surface thereof abuts a return stop of the flashing product) while in other embodiments, portions of the fenestration product may extend further into the opening than the flashing product. An optional step 412 attaches the fenestration product to the structure, for example to the exterior surface and/or framing of the structure. Step 412 may or may not involve the flashing product, e.g., a fenestration product might be fastened directly to the exterior surface and/or framing behind return 120. One example of step 412 is nailing fin 60 of window product 50(1) to exterior surface 10 and/or framing 40, FIG. 1. In embodiments, a fenestration product can be attached into the flashing product, exterior surface and/or framing in other ways, for example with fasteners penetrating through the flashing product. The flashing product may be manufactured for a particular fenestration product that is associated with other attachment methods in which a fastener penetrates the flashing product. In such case, the flashing product may be formed with self-healing adhesive in appropriate locations so that when the attachment method penetrates the flashing product, the self healing adhesive seals about the fastener. An optional step 416 is a special case of step 412 wherein the fenestration product attaches to the structure by passing a fastener through the flashing product, with self-healing adhesive sealing about the fastener.

Figure 11A:
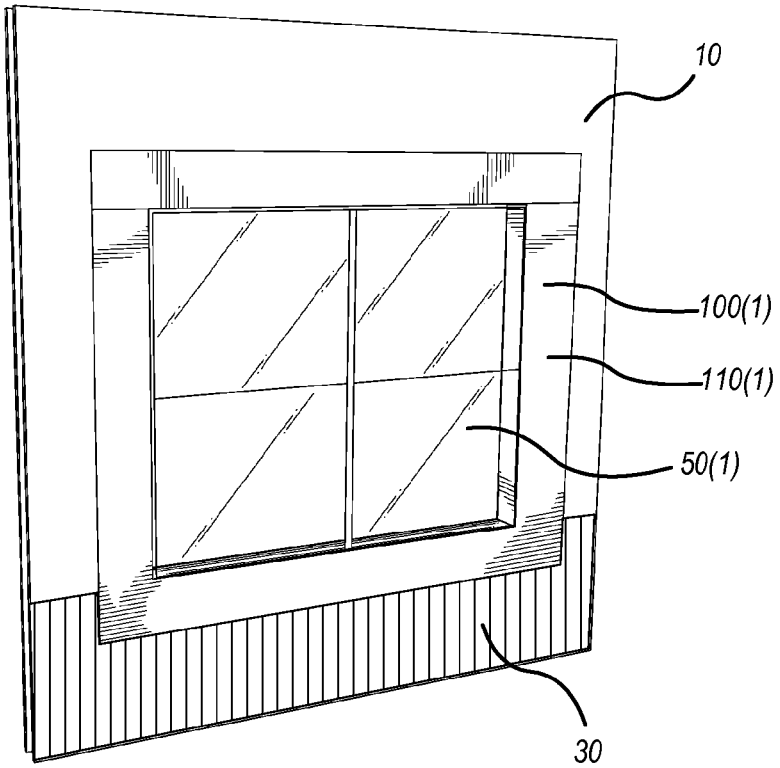
FIGS. 11A and 11B schematically illustrate construction steps following installation of the prefabricated flashing product of FIG. 1, according to an embodiment.
Figure 11B:
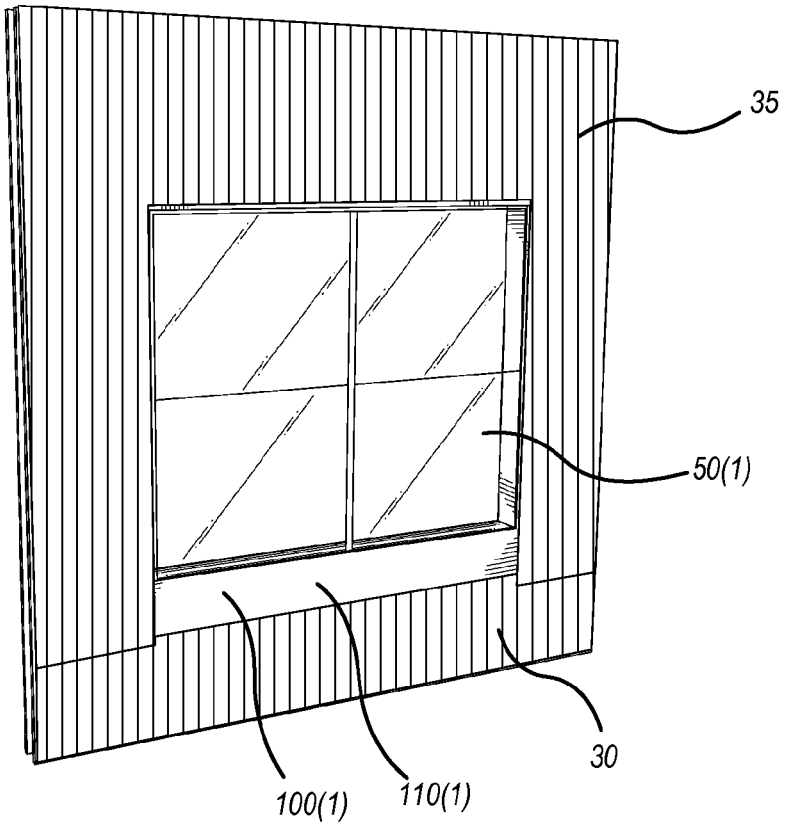

When the fenestration product includes a nailing fin and the flashing product includes an upper flap, another optional step 420 folds the upper flap over the nailing fin such that the nailing fin is disposed between the flange and the upper flap. An example of step 420 is folding upper flap 170 over nailing fin 60 such that nailing fin 60 is disposed between flange 110(1) and upper flap 170, FIG. 1 and FIG. 6. Step 420 may include an optional step 424 of sealing an adhesive strip of the upper flap to an outer surface of the nailing fin. An example of step 424 is sealing adhesive strip 180 to an outer surface of nailing fin 60, FIG. 6. Step 420 may also include an optional step 428 of sealing an adhesive strip of the flange to an inner surface of the nailing fin. An example of step 428 is sealing adhesive strip 187 to an inner surface of nailing fin 60, FIG. 6. Another optional step 430 fastens the upper flap and/or the flange to the exterior surface. An example of step 430 is nailing upper flap 170 and/or flange 110(1) to exterior surface 10, FIG. 1 and FIG. 6. Similar to step 416, step 430 can include penetrating the upper flap and/or flange with a fastener, and a self-healing adhesive can be utilized so that the adhesive seals around the fastener. Another optional step 440 installs a weather resistant barrier over the flange and upper flap. An example of step 440 is installing upper weather resistant barrier 35 over flange 110 and upper flap 170, as shown in FIGS. 11A and 11B.

Figure 5:
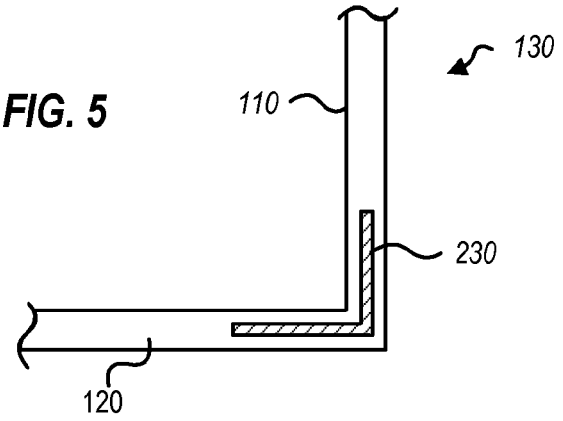
FIG. 5 is a schematic cross-section of a portion of a top member of the prefabricated flashing product of FIG. 1, showing how the flashing product can be molded about an optional reinforcing member, according to an embodiment.

FIG. 5 is a schematic cross-section of a portion of top member 130 showing how a flashing product 100 can be molded about an optional reinforcing member 230. Reinforcing member 230 can be made of any relatively rigid material, such as metal or fiberglass. Reinforcing member 230 typically need not be strong enough to lend significant support as compared to framing of a structure or a window to be mounted therein, but additional rigidity of product 100 due to incorporation of member 230 can be helpful during manufacturing, transport and installation of product 100. For example, the rigidity of product 100 may help hold product 100 in place for easier manipulation of product 100 relative to the structure and fenestration product that it is utilized with, as opposed to a plastic or rubber flashing product 100 that may tend to sag where unsupported.

Figure 15:
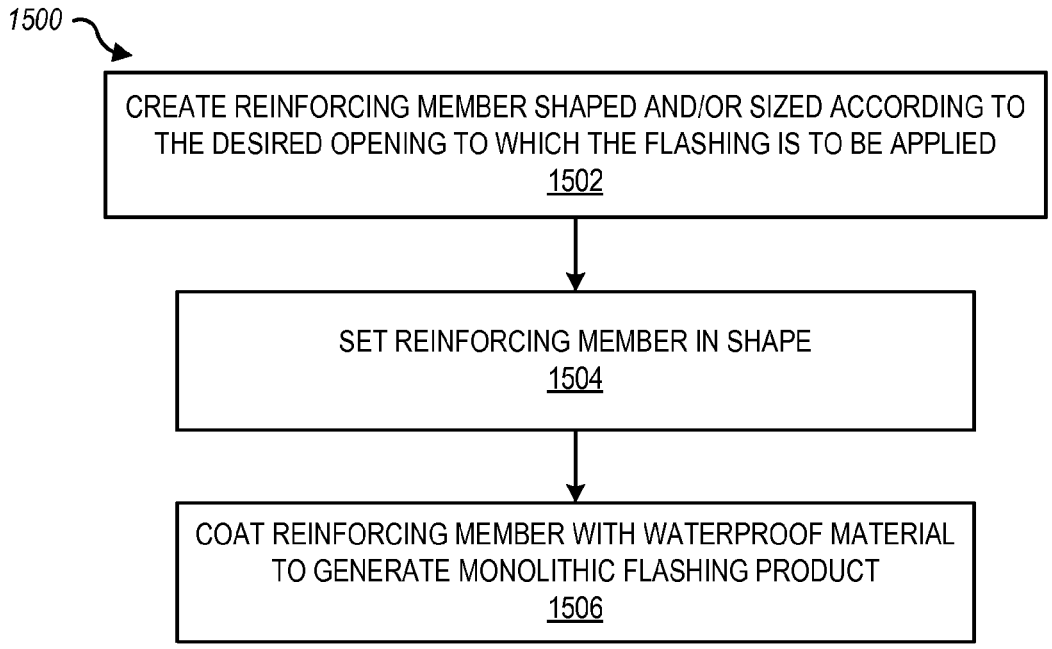
FIG. 15 is a flowchart illustrating one exemplary method of manufacturing a prefabricated flashing product utilizing reinforcing member, in an embodiment.
Figure 16:
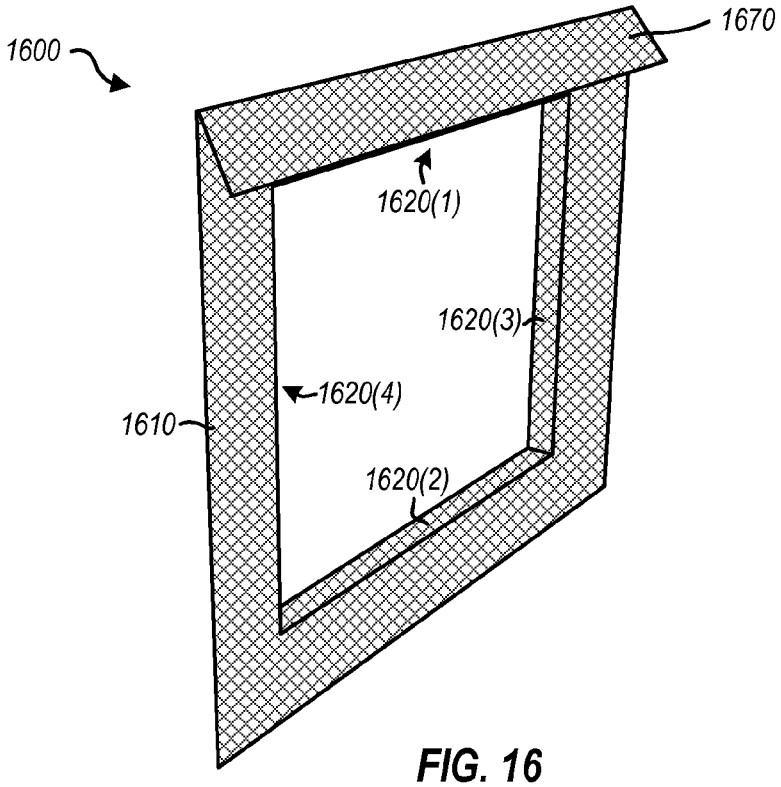
FIG. 16 shows one exemplary reinforcing member used during the method of FIG. 15, in an embodiment.

FIG. 15 is a flowchart illustrating one exemplary method 1500 for manufacturing a prefabricated flashing product utilizing reinforcing member 230, in one embodiment. FIG. 16 depicts an exemplary reinforcing member 1600 used during method 1500, in an embodiment. FIGS. 15 and 16 are best viewed together with the following description.

In step 1502, a reinforcing member is generated correlating to the desired shape and features of the finished flashing product. For example, reinforcing member 230, discussed above, is formed out of any material capable of holding the general shape desired for the finished flashing product. For the purposes herein, reinforcing member 1600 of FIG. 16 is one example of reinforcing member 230, discussed above. The reinforcing member may be formed out of a plastic, rubber, metal, fabric, paper, cardboard or other material that is capable of holding the desired shape. In one example of step 1502, reinforcing member 1600 of FIG. 16 is formed from a malleable mesh formulated of one or more of the above materials. The mesh reinforcing member 1600 is bent, or otherwise shaped, to include a generally planar flange 1610, and a return 1620 attached thereto having top 1620(1), bottom 1620(2) and side 1620(3), 1620(4) members. Reinforcing member 1600 is also illustrated with an upper flap 1670 formed from the mesh and couples with the top portion of flange 1610.

Reinforcing member 1600 may further include any of features discussed herein and may also be shaped and/or sized according to the desired opening to which flashing is to be applied. For example, reinforcing member 1600 may be shaped into a curved return/flange configuration, as illustrated in FIG. 7 and/or reinforcing member 1600 may include an end dam (e.g. end dam 192 of FIG. 2), a return channel (e.g. return channel 194 of FIG. 2), a drip margin (e.g. drip margin 190 and/or 195 of FIG. 2), a return stop (e.g. return stop 210 of FIG. 3), and ribs (e.g. ribs 220 of FIG. 3). Those of ordinary skill in the art will understand that other features described herein may be included in or on reinforcing member 1600 without departing from the scope hereof.

In optional step 1504, the reinforcing member 1600 is set in shape. For example, where the reinforcing member 1600 is formed from a fabric or other fairly slack material that does not retain a given shape, then a coating may be applied such that reinforcing member 1600 maintains a given shape. Such coating material may be a glue, adhesive, resin, or other material that increases the stiffness of the reinforcing member 1600.

In step 1506, reinforcing member 1600 is coated with a waterproof material to form a monolithic flashing product. In one example of step 1504, reinforcing member 1600 is coated with a material selected from the group of materials including plastics, plastic based materials, rubber, rubber based materials, bitumen, asphalt, asphalt based materials, or any other material capable of coating reinforcing member 1600 by one or both of dipping and spraying as would be appreciated by those of ordinary skill in the art. The coating process may include spraying and/or dipping the shaped reinforcing member 1600 into the material.

Method 1500 provides significant advantages over other methods of manufacturing the flashing product. For example, method 1500 does not require production of molds for manufacturing the monolithic flashing product. Such molds are highly expensive and a different mold is required for each given size, shape, and configuration of the desired flashing product. To the contrary, the present method 1500 allows for simplistic variance of the flashing product design, shape, and configuration, without the expense associated with producing a given mold for each flashing product configuration.

Figure 6:
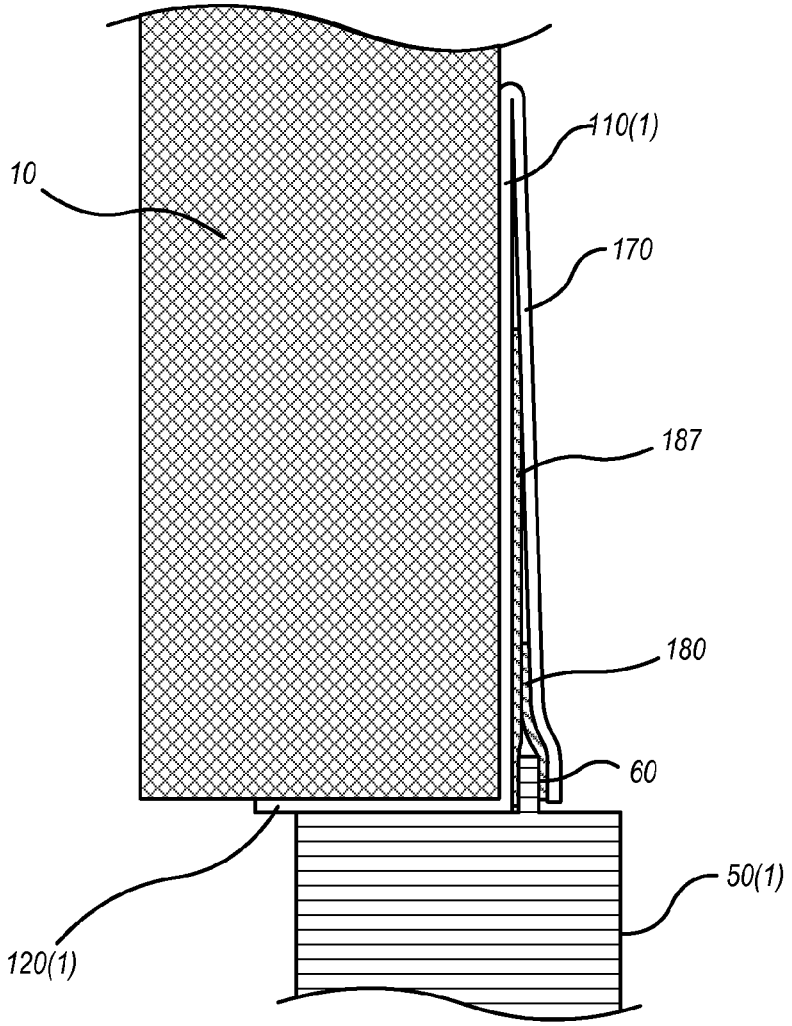
FIG. 6 is a schematic cross-section illustrating the arrangements of an exterior surface, a top member of the prefabricated flashing product of FIG. 1, and a window product after installation, according to an embodiment.

FIG. 6 is a schematic cross-section illustrating the arrangements of surface 10, top member 130 of flashing product 100(1), and window product 50(1) after installation. A portion each of surface 10 and window product 50(1) are schematically shown. Return 120(1) of top member 130 is disposed between surface 10 and window product 50(1). Flange 110(1) is disposed adjacent to surface 10, and upper flap 170 folds down from flange 110(1) at upper edge 115. Upper flap 170 folds over nailing fin 60 of window product 50(1) such that nailing fin 60 is between upper flap 170 and flange 110(1). Adhesive strip 187 seals to both an inner surface of nailing fin 60 and upper flap 170, and adhesive strip 180 seals to both an outer surface of nailing fin 60 and adhesive strip 187.

It should be apparent that prefabricated flashing product 100 may be utilized in structures intended to provide protection from weather, such as houses, retail, office, industrial or agricultural buildings, and/or vehicles, such as automobiles, trucks, trains, trailers, ships and boats. Certain of these structures may include windows, doors, skylights or other fenestrations that need to maintain weather resistance over curved surfaces. FIG. 7 is a schematic cross-section illustrating a prefabricated flashing product 100(2) having a curved shape adapted for use with a structure having a curved exterior surface 10(2), and with a curved fenestration product 50(2). Exterior surface 10(2) of a structure forms opening 20(2), and a flange 110(2) of product 100(2) is shaped to conform to exterior surface 10(2), as shown. Return 120(2) is shaped to fit within opening 20(2), and product 100(2) forms an aperture 150(2) that accepts fenestration product 50(2). In all respects other than the curved surface and window that it is adapted to, installation and performance of product 100(2) is the same as that of product 100(1) described above. Although FIG. 7 shows an outwardly curved fenestration product, embodiments herein may be adapted for use with inwardly curved fenestration products as well.

Figure 8:
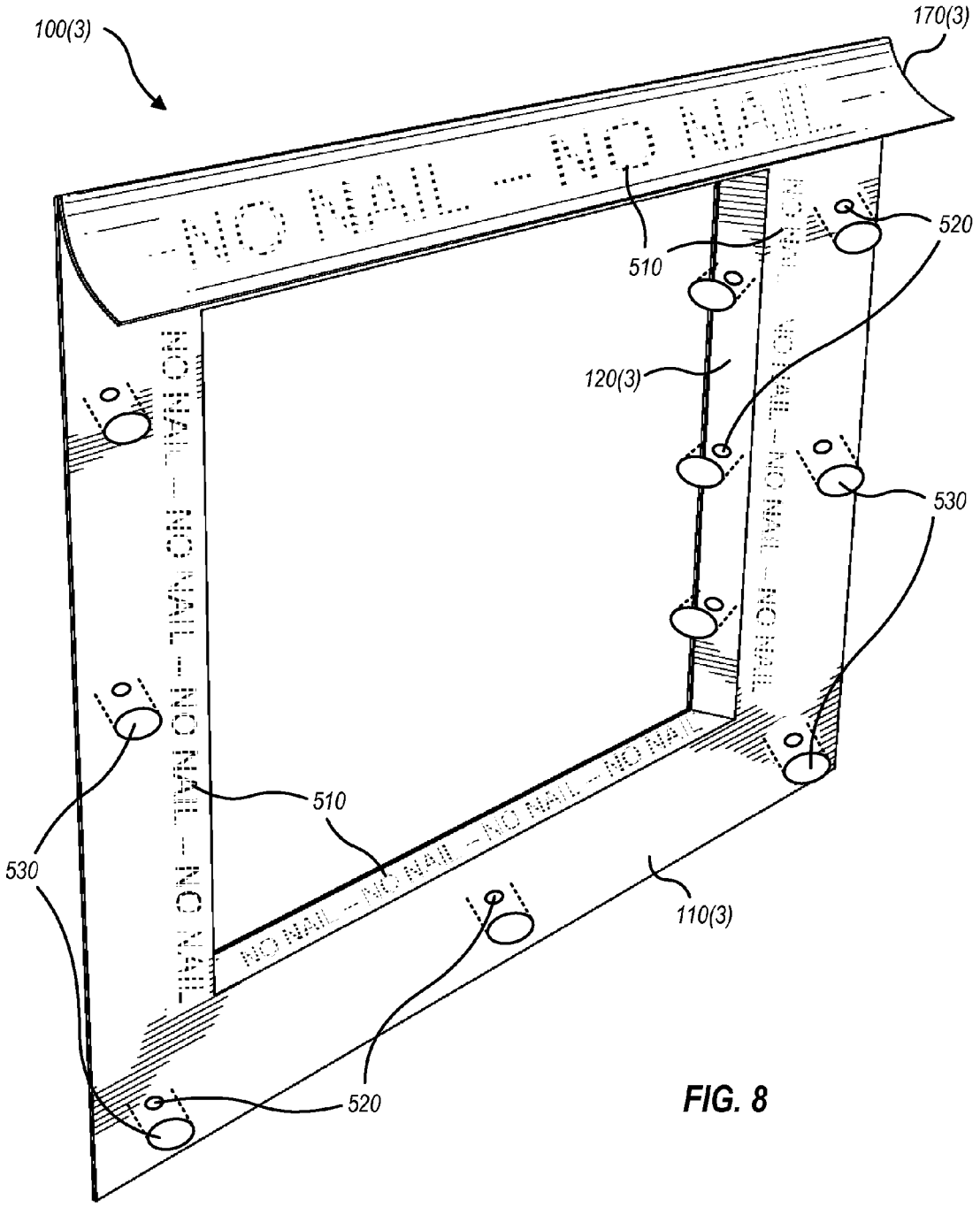
FIG. 8 schematically shows a prefabricated flashing product with several locations marked with indicia, according to an embodiment.

In certain embodiments, a prefabricated flashing product may include indicia thereon to guide installers about installation and in particular, sites on the product where nail holes are to be avoided, to maintain weatherproof integrity of the product. FIG. 8 schematically shows a prefabricated flashing product 100(3) with several locations 510 marked with "NO NAIL" to indicate places where installers should not nail or otherwise perforate flashing product 100(3). Flange 110(3), upper flap 170(3) and return 120(3) correspond to the like numbered elements in FIGS. 1-3 and 5-7. Indicia forbidding perforation (e.g., "NO NAIL") may correspond with portions of flange 110(3) and/or upper flap 170(3) that do not have a self-healing adhesive in place that would seal any nail holes or other perforations. Product 100(3) also includes several pre-drilled locations 520 to suggest places where installers can or should utilize nails or other fasteners during installation. When prefabricated flashing product 100(3) includes pre-drilled locations 520, installation instructions may include instructions that such holes must be sealed before the installation is complete (e.g., by caulking, or by applying an adhesive patch 530 over the locations, as shown). Not all pre-drilled locations 520 or adhesive patches 530 are labeled in FIG. 8, for clarity of illustration.

Figure 9A:
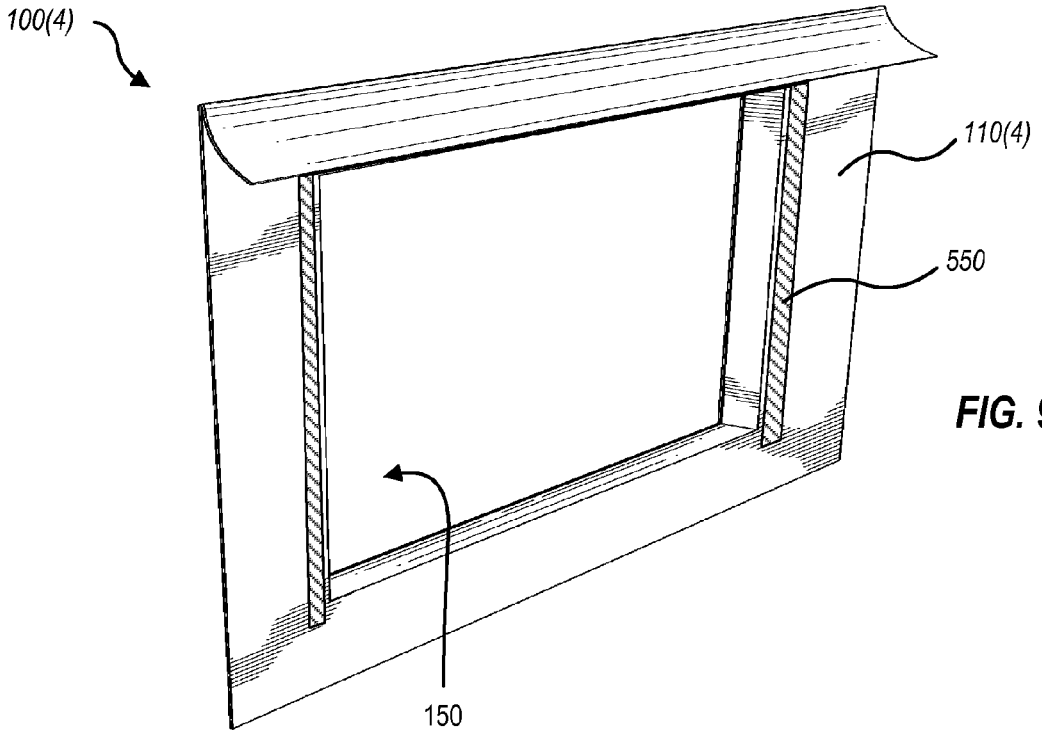
FIG. 9A and FIG. 9B are front and rear perspective views, respectively, of a prefabricated flashing product showing adhesive strips in additional locations, to facilitate further sealing of the flashing product to an exterior surface underneath and a building product installed therein, according to embodiments.
Figure 9B:
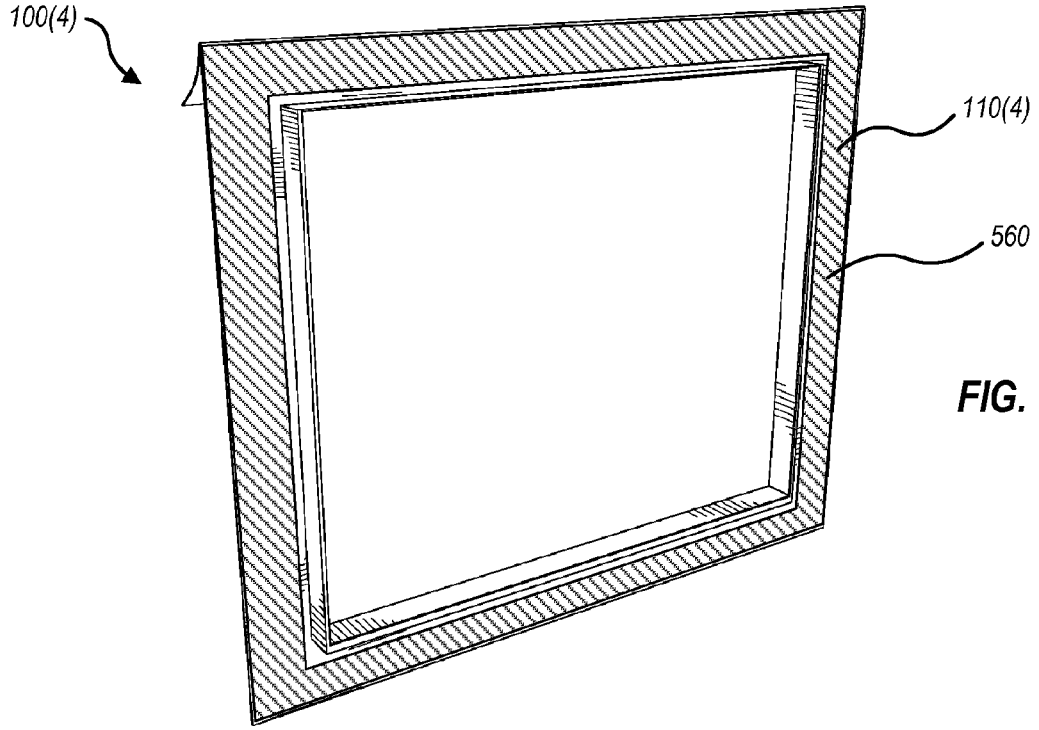

FIG. 9A and FIG. 9B are front and rear perspective views, respectively, of a prefabricated flashing product 100(4) showing optional adhesive strips in additional locations, to facilitate further sealing of product 100(4) to an exterior surface underneath and a building product installed therein. FIG. 9A shows an optional adhesive strip 550 located on flange 110(4), just outside aperture 150 to the top and sides thereof. Certain building products are supplied with a flange intended to butt up against an opening in which the product is installed. Sealant is sometimes applied around a backside of such flanges, to provide additional weather resistance. Adhesive strip 550 can take the place of the sealant that would have been used. Adhesive strip 550 may be supplied with a release paper in place to preserve its adhesion until product 100(4) is installed. Adhesive strip 550 does not continue along the bottom side of aperture 150, so that any liquid moisture in that area can drain outwardly from aperture 150. FIG. 9B shows an optional adhesive strip 560 substantially covering an entire rear surface of flange 110(4). Adhesive strip 560 can seal flange 110(4) directly to an exterior surface such that any moisture that penetrates behind a weather resistant barrier over flange 110(4) will not be able to proceed to an opening in the exterior surface in which product 100(4) mounts. Of course, adhesive strip 560 can also be supplied with a release paper in place to preserve its adhesion until product 100(4) is installed. Either or adhesive strips 550, 560 may include a self-healing adhesive that can seal around a fastener driven through it, such as a fastener utilized to fasten flashing product 100(4) to a structure or utilized to fasten a fenestration product, through flashing product 100(4), to a structure. In alternative embodiments, adhesive strips 550 and 560 are not provided; in such cases a flashing product can be installed without adhesive seals in the corresponding locations, or sealing can be done during installation by utilizing conventional sealants.

Figure 10:
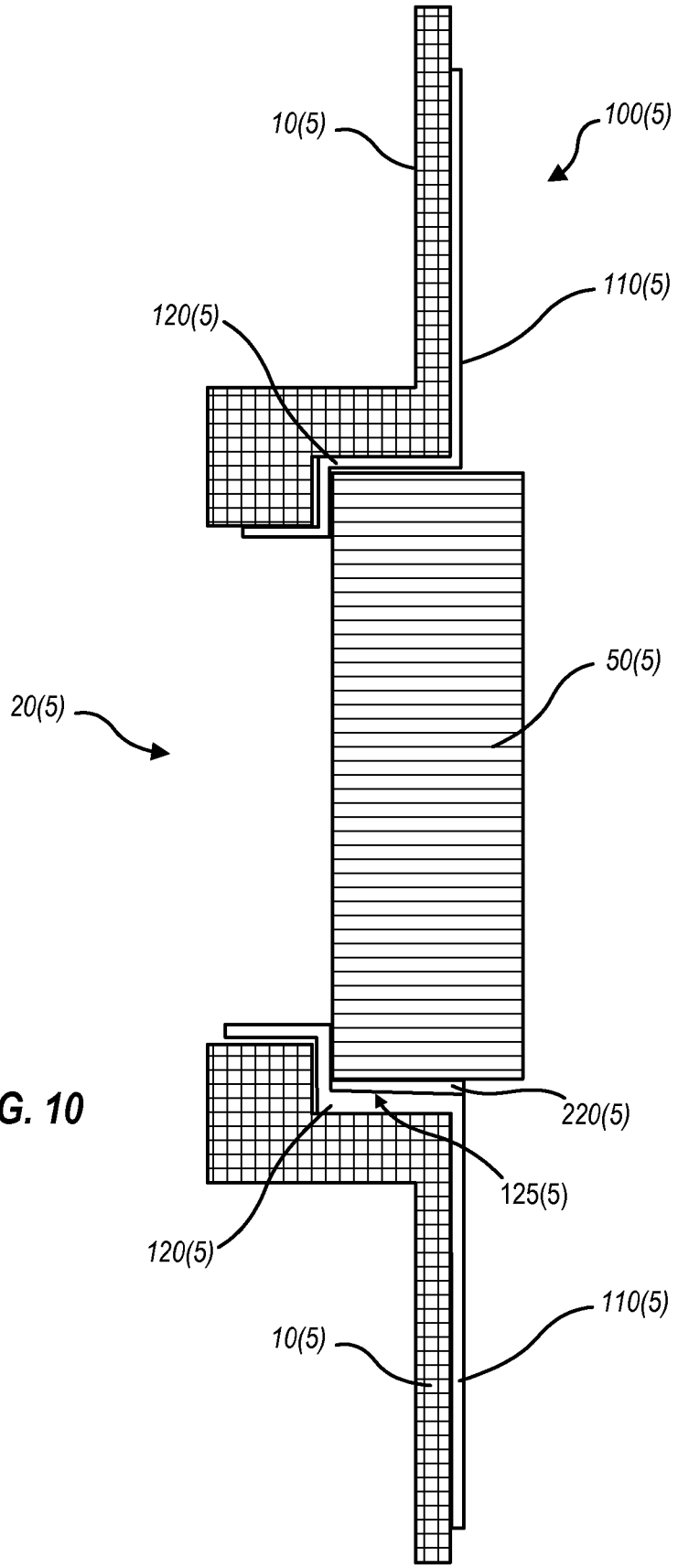
FIG. 10 is a schematic cross section that illustrates an exterior surface having an opening that expands stepwise in the vertical direction, and a prefabricated flashing product that can be utilized with such an opening, according to an embodiment.

The prefabricated flashing product described herein can be adapted to a variety of common architectural approaches to defining and framing features that penetrate an exterior surface of a structure, such as windows. One such variation is a stepped frame in which an opening in the structure is of a given size at one point in the exterior surface, and expands stepwise to a slightly larger size at the exterior surface. The stepwise expansion of the opening may be in the horizontal or vertical directions or both. FIG. 10 is a schematic cross section that illustrates an exterior surface 10(5) having an opening 20(5) that expands stepwise in the vertical direction, and a prefabricated flashing product 100(5) that can be utilized with such an opening. Return 120(5) of flashing product 100(5) includes steps that follow the steps in opening 20(5), as shown. A bottom interior surface 125(5) slopes towards flange 110(5). Stepped fenestration product 50(5) is disposed on ribs 220(5) that provide an unsloped surface. One skilled in the art will appreciate that prefabricated flashing products can be modified similarly to the way flashing product 100(5) follows the steps in opening 20(5), to provide similar flashing performance for a variety of openings in structures.

FIGS. 11A and 11B schematically illustrate construction steps following installation of prefabricated flashing product 100. Flashing product 100(1) and window product 50(1), FIG. 1, are utilized as an example in FIGS. 11A and 11B; but it should be apparent that the techniques described here can be adapted to other embodiments of flashing product 100 and other fenestration products. FIG. 11A shows the same features as in the exploded view of FIG. 1, but with flashing product 100(1) and window product 50(1) installed on exterior surface 10. If lower weather resistant barrier 30 is utilized at all, it is installed first on exterior surface 10, followed by flashing product 100(1), to achieve the overlap of flashing product 100(1) over barrier 30, as shown in FIG. 11A. This is followed by installing window product 50(1), and optionally sealing window product 50(1) into flashing product 100(1) (e.g., by folding down upper flap 170, FIG. 1). FIG. 11B shows the addition of upper weather resistant barrier 35, which covers the top, left and right side members of flashing product 100(1) (e.g., members 130, 140 and 145, FIG. 1). Upper weather resistant barrier 35 can be sealed to window product 50(1), while flashing product 100(1) is unbroken around the periphery of window product 50(1). Thus, flashing product 100(1) does not have lapping or other joints in corners that can compromise the weather resistance of product 100(1).

Figure 12:
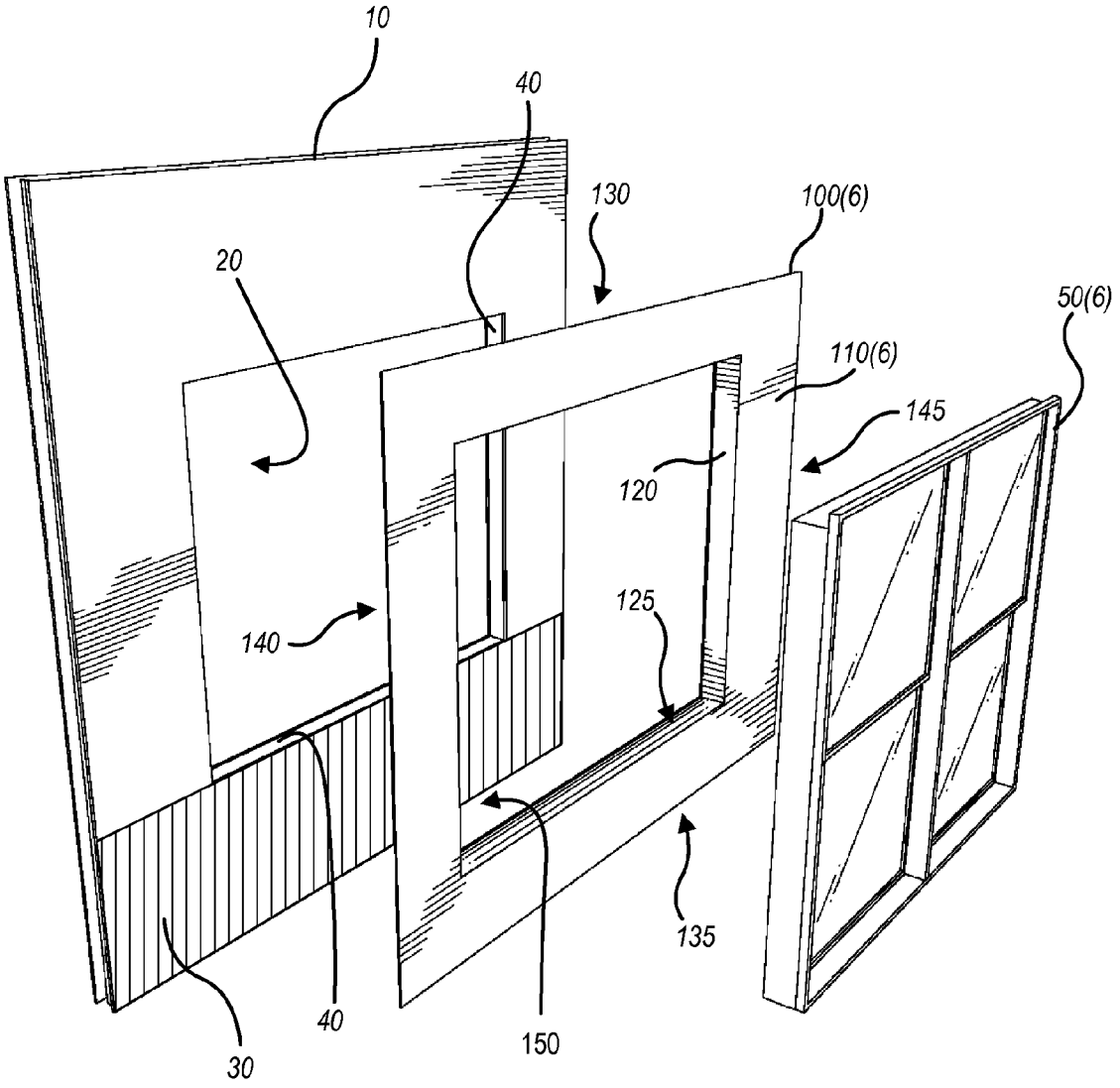
FIG. 12 is an exploded drawing that shows a prefabricated flashing product between an exterior surface of a structure that forms an opening, and a window product to be installed within the opening.

FIG. 12 is an exploded drawing that shows a prefabricated flashing product 100(6) between exterior surface 10 of a structure that forms an opening 20 (e.g., the same surface 10 and opening 20 as shown in FIG. 1), and a window product 50(6) to be installed within opening 20. Window product 50(6) does not include a nailing fin, and correspondingly flashing product 100(6) does not include an upper flap. Although FIG. 12 shows a rectangular flashing product 100(6) for rectangular opening 20, like flashing products may be adapted to openings of different shapes, such as for example curved or circular openings.

Figure 13:
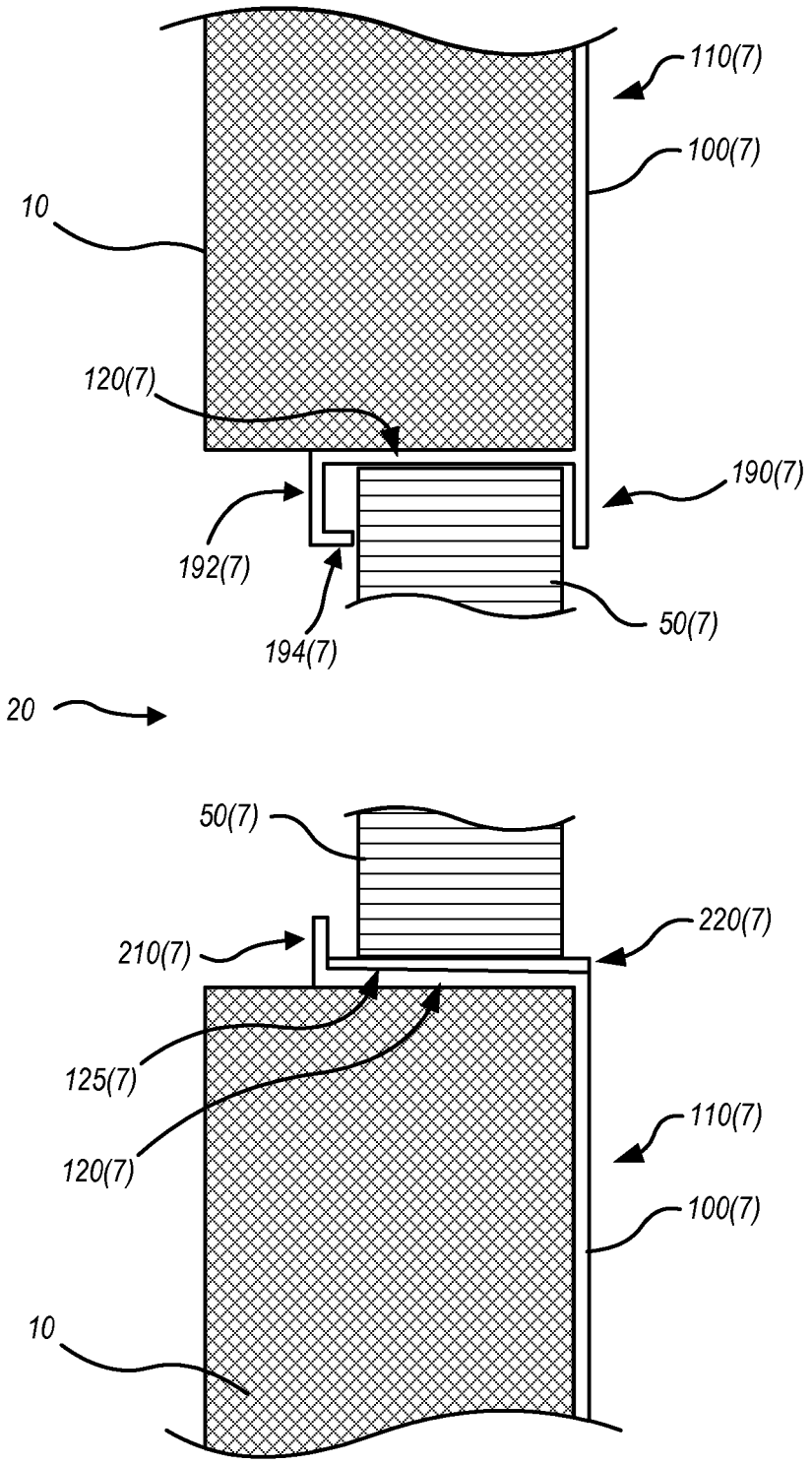
FIG. 13 is a schematic cross-sectional drawing of a prefabricated flashing product installed with a fenestration product that lacks a nailing fin, within an opening of a structure.

FIG. 13 is a schematic cross-sectional drawing of a prefabricated flashing product 100(7) installed with a fenestration product 50(7) that lacks a nailing fin, within opening 20 of exterior surface 10. Portions of surface 10, flashing product 100(7) and fenestration product 50(7) are cut away to show the features of flashing product 100(7) more clearly. Flashing product 100(7) includes a flange 110(7) and a return 120(7), as shown. A top member of flashing product 100(7) includes a drip margin 190(7) below and adjoining flange 110(7) at a proximal edge of return 120(7), and an end dam 192(7) and a return channel 194(7) formed below and adjoining a distal edge of return 120(7), as shown. A bottom member of flashing product 100(7) includes ribs 220(7) that support fenestration product 50(7) at least during installation, and a return stop 210(7). Drip margin 190(7) helps to divert liquid moisture downwards past the top edge of fenestration product 50(7). Moisture that does pass over the top edge of fenestration product 50(7) is blocked from the interior of surface 10 by end dam 192(7), and drains to return channel 194(7). Return channel 194(7) carries such liquid moisture to sides of flashing product 100(7) (not shown in the cross sectional plane of FIG. 13) where it drains to bottom interior surface 125(7) of return 120(7). Surface 125(7) is sloped to urge liquid moisture outwardly from the front of fenestration product 50(7). Flashing product 100(7) includes ribs 220(7) that support fenestration product 50(7) at least during installation, due to the slope of bottom interior surface 125(7).

In separate embodiments of the fenestration flashing product, the flashing product may be formed of expandable material. The term "expandable," as used herein, is intended to include stretching and/or expanding in size. Forming the fenestration flashing product of an expandable product has the benefit of (1) accommodating a range different window, door, and/or opening sizes (2) forming to minor variations in a range of different window, door, and/or openings, and (3) to accommodating construction tolerances within a range of different window, door, and/or opening sizes.

The following discusses two embodiments of expandable fenestration flashing product. It will be understood that alternatives and variations to the expandable flashing products may be conceived of that include some or all the elements disclosed above with respect to prefabricated flashing product 100(1) through 100(7), without departing from the scope herein. The embodiments of expandable fenestration flashing products include an expandable window flashing formed entirely of expandable material and an expandable window flashing product formed of expandable material including substantially rigid corner elements. As similarly discussed above, these embodiments of flashing products secure to a fenestration within a structure for the purpose of reducing or substantially eliminating the ingress of moisture into the architectural structure. Although this discussion discusses windows, it will be understood that the present expandable flashing embodiments may be used with any fenestration, for example windows, doors, vents, etc., without departing from the scope herein. In some embodiments, the bottom portion of an expandable flashing product is configured with drain elements to allow for the egress of moisture.

In one embodiment, prefabricated flashing product 100(1) is formed as an expandable window flashing fabricated entirely of expandable material from, for example, a flat sheet by cutting, stamping, and/or forming the expandable flashing product from a sheet of expandable material, using known techniques. One example of a potential expandable material is a stretchable Butyl compound. It is preferable that the expandable flashing product be formed with an outer perimeter larger than opening 20 (FIG. 1) onto which it is to be secured, and an internal perimeter smaller than opening 20. The expandable flashing product has a height and an outer width defined by the outer perimeter of the expandable flashing product. The expandable flashing product also has one or more inner widths defined by the difference between the outer perimeter and an inner perimeter of the centrally located aperture. The inner width may be selected during the design or manufacturing process to relate to the dimensions of window openings, similar to opening 20, onto which the expandable flashing product is to accommodate. One design parameter may be the amount the expandable flashing product is to "reach" past a window's outer edges. Another design parameter may be the preferred location of the window's edges within the inner width of the expandable flashing product, for example, half the distance between the inner and outer perimeter of the expandable flashing product. The stretch and inner width of the expandable flashing product may be optimized to accommodate a number of window opening sizes and, in some cases, window opening shapes. In certain embodiments, the product may be formed of an initial size, and be able to expand/stretch between 0 and 30% of the initial size. Accordingly, the expandable product may be formed in varying initial sizes, and then stretched to accommodate unique window sizes and shapes.

It will be understood that the expandable flashing product may be formed with or without an adhesive backing. In an embodiment that does not include an adhesive backing, the expandable flashing product may be secured to the opening/fenestration with known securing mechanism, such as staples, screws, nails, capped screws, capped nails, or similar. In an embodiment that includes an adhesive backing, for example similar to adhesive strip 560 (FIG. 9B), the adhesive backing may be covered with a protective adhesive covering, such as a paper or plastic adhesive covering. Optionally, the adhesive is a two part adhesive with a first part formed on the back of the expandable flashing product and the second part applied to the mating surfaces on the fenestration during installation. The two part adhesive then actives during or within a period of time after the two parts meet. An embodiment utilizing a two part adhesive may not require, but may still benefit from, a protective adhesive covering. In adhesive backed or non-adhesive backed embodiments, the expandable flashing product is formed with self-healing properties, for example, with a self-healing adhesive sealant about fastener locations or over its entirety.

In one example of installation, discussed in reference to FIG. 1, the expandable window flashing with adhesive is secured to exterior surface 10 of the opening 20, for example starting at the top of the window opening and working downward. Next, the expandable window flashing is secured to the window's inner surfaces, i.e., the sill, jamb, and top of fenestration shown as framing 40, by pressing the expandable flashing product into the opening 20, especially at the windows corners where the material with stretch to accommodate the corners, to bond the adhesive layer with opening 20. A j-roller may be utilized to further adhere the adhesive backing of the expandable flashing product to exterior surface 10 and opening 20.

In separate embodiment, prefabricated flashing product 100(1) is formed as an expandable window flashing having four substantially rigid, wrap around corner elements connected by expandable sides (not shown). The expandable sides may be fabricated in manner similar to that of the above discussed expandable window flashing product. The wrap around corners include internal corners for fitting within opening 20 at framing 40, and external corners for fitting to the two external corners formed by framing 40 and exterior surface 10. These wrap around corner elements may form a 3-dimensional corner unit such that, when installed, each corner element is in contact with three surfaces of a window opening; the window sill (or top) and the window jamb formed by framing 40, and exterior surface 10 of the structure into which fenestrations are formed. The substantially rigid corners may be formed using any of a number of known techniques, including but not limited to, injection molding, CNC machining, 3-D construction from folding or bending 2-D cut parts, etc. The expandable sides of the expandable window flashing with substantially rigid corners are secured to the wrap around corner elements from the corner element's window sill/jamb portions to the corner element's outer surface of the structure portions such that a bend is formed in the expandable sides.

In the present embodiment, an adhesive, for example, similar to adhesive strip 560, may be formed on the back surface of one or both of the wrap around corner elements and the expandable flashing product. If adhesive is not used, fastener may be required to secure the expandable window flashing product with substantially rigid corners to a fenestration. One benefit of the present embodiment is the wide range of window openings the expandable window flashing with substantially rigid corners may fit due to the cooperation between anchored, substantially rigid corners and stretchable, expandable sides. By anchoring a corner then stretching the expandable sides, any number of window sizes and shapes may be accommodated.

Figure 14:
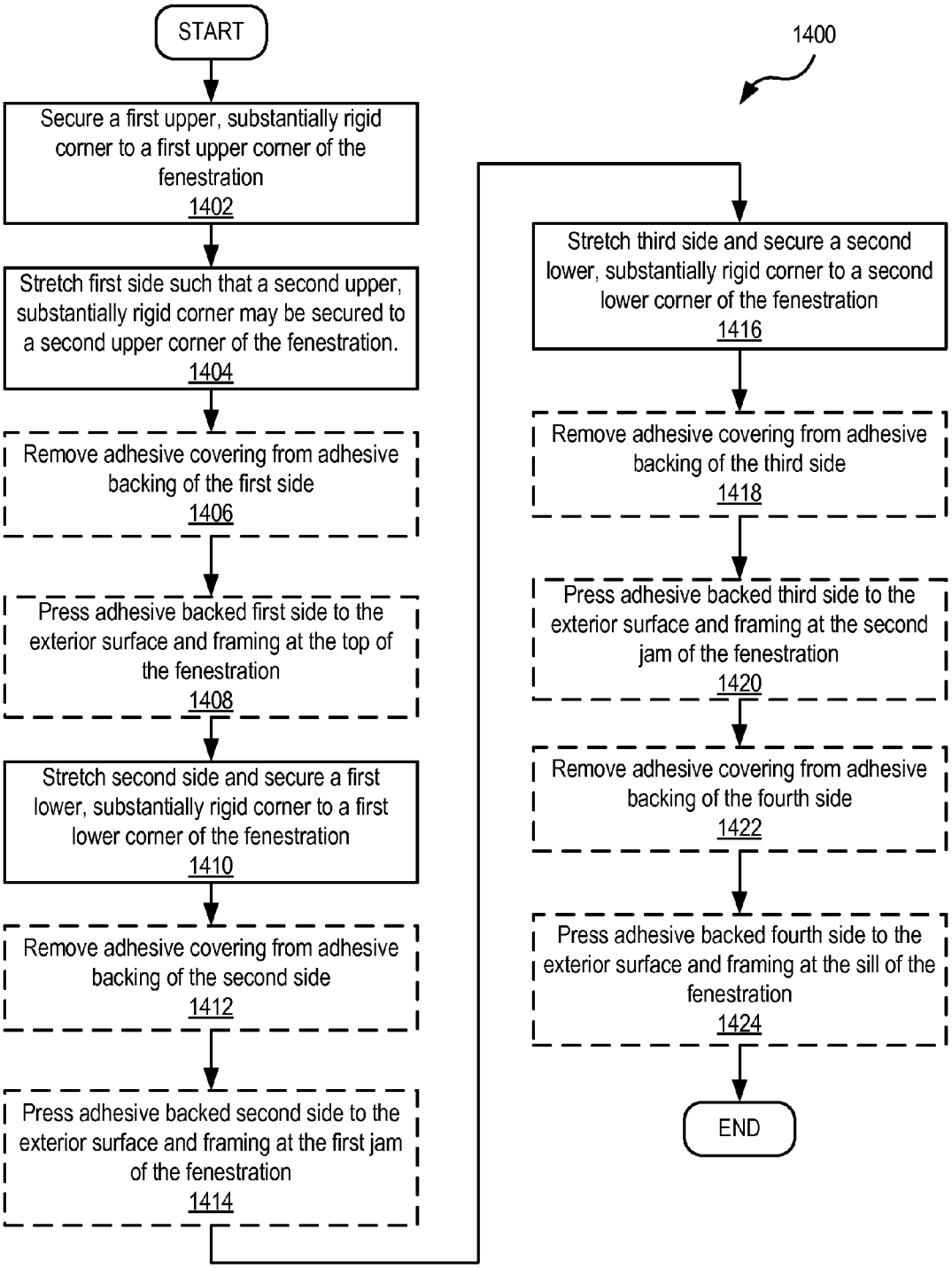
FIG. 14 shows one exemplary method for installing an expandable window flashing with substantially rigid corners with adhesive backing.

FIG. 14 shows one exemplary method 1400 for installing an expandable window flashing with substantially rigid corners with adhesive backing. Prior art window flashing require a bottom up installation process, which creates a water resistant, overlapping system, sometimes referred to as a "shingle fashion." This method is required to create a water resistant system when a flashing system is formed of multiple components. There are a number of drawbacks to this prior art system, including the inflexibility to the installation process and "weak links" in the water resistance due to the plurality of joints at each point of overlap. The unitary structure of the present system solves at least the above stated problems associated with the prior art. For example, the unitary structure of the present system eliminates "weak links" associated with joints at joints. In addition, the unitary structure of the present system does not require an overlapping installation process, and does not require a bottom up installation process. In fact, the present system may be installed from the bottom up, top down, left to right, right to left, and even diagonally or any combination thereof.

It will be understood that the present method is described using a top down process. As stated above, a top down process is not necessary for the installation of an expandable window flashing, it does beneficially use the gravity during the process.

In step 1402 of method 1400 a first upper, substantially rigid corner is secured to a first upper corner of a fenestration. One example of step 1402 is securing the upper, right substantially rigid corner of an expandable window flashing with substantially rigid corners to the upper, right corner of a fenestration by nailing, screwing, and/or adhering the substantially rigid corner at one or both of exterior surface 10 and framing 40.

In step 1404, a first expandable side is stretched such that a second upper, substantially rigid corner is positioned and secured to a second upper corner of the fenestration. One example of step 1404 is stretching a first expandable side down toward a upper left hand corner of the fenestration. The upper left, substantially rigid corner of the expandable window flashing is then secured to the upper left inner corner of the fenestration by nailing, screwing, and/or adhering the substantially rigid corner at one or both of exterior surface 10 and framing 40.

In optional step 1406, an adhesive covering, such as a paper or plastic covering, is removed from an adhesive backing of the first side. One example of step 1406 is removing the adhesive covering from the adhesive backing on the expandable window flashing with substantially rigid corners.

In optional step 1408, the adhesive backing of the first side is pressed and adhered to the upper exterior corner of the fenestration. One example of step 1408 is pressing the first expandable side with adhesive backing to the upper edge of the fenestration formed by exterior surface 10 and framing 40.

In step 1410, a second side of the expandable window flashing with substantially rigid corners is stretched such that a first lower, substantially rigid corner is positioned and secured to a first lower corner of the fenestration. One example of step 1410 is stretching a second expandable side down toward a lower left hand corner of the fenestration. The lower left, substantially rigid corner of the expandable window flashing is then secured to the lower left inner corner of the fenestration by nailing, screwing, and/or adhering the substantially rigid corner at one or both of exterior surface 10 and framing 40.

In optional step 1412, an adhesive covering is removed from an adhesive backing of the second side. One example of step 1412 is removing an adhesive covering from an adhesive backing on the expandable window flashing with substantially rigid corners.

In optional step 1414, the adhesive backing of the second side is pressed and adhered to the left, exterior corner of the fenestration. One example of step 1414 is pressing the expandable side with adhesive backing to the left exterior corner of the fenestration formed by exterior surface 10 and framing 40 at the left jam.

In step 1416, a third side and fourth side of the expandable window flashing with substantially rigid corners are stretched such that a second lower, substantially rigid corner is positioned and secured to a second lower corner of the fenestration. One example of step 1416 is stretching a third and a fourth expandable side toward a lower right hand corner of the fenestration. The lower right, substantially rigid corner of the expandable window flashing is then secured to the lower right inner corner of the fenestration by nailing, screwing, and/or adhering the substantially rigid corner at one or both of exterior surface 10 and framing 40.

In optional step 1418, an adhesive covering is removed from an adhesive backing of the third side. One example of step 1418 is removing the adhesive covering from the adhesive backing on the expandable window flashing with substantially rigid corners.

In optional step 1420, the adhesive backing of the third side is pressed and adhered to the right, exterior corner of the fenestration. One example of step 1414 is pressing the expandable side with adhesive backing to the right exterior corner of the fenestration formed by exterior surface 10 and framing 40 at the right jam.

In optional step 1422, an adhesive covering is removed from an adhesive backing of a fourth side. One example of step 1422 is removing the adhesive covering from the adhesive backing on the expandable window flashing with substantially rigid corners.

In optional step 1424, the adhesive backing of the fourth side is pressed and adhered to the exterior corner of the fenestration at the sill. One example of step 1424 is pressing the expandable side with adhesive backing to the exterior corner of the fenestration formed by exterior surface 10 and framing 40 at the sill.

It will be understood that the steps of method 1400 need not be performed in the order described and variations are available to one skilled in the art without departing form the scope herein. One example of a variation to method 1400 is securing all substantially rigid corners of an expandable window flashing with substantially rigid corners prior to removing the adhesive covers from the adhesive backing. In addition, intermediate step may be performed between the steps described in method 1400. Also, the corners may or may not be substantially rigid in that the corners may not have substantially rigid corner elements surrounded by the expandable material. Instead, the expandable window flashing may be formed only from the expandable material.

It will be understood that the expandable fenestration flashing product may be used with a components to create an expandable fenestration flashing product system. For example, a slope or ramp element may be applied to the all or a portion of the bottom interior surface of the fenestration such that when the expandable fenestration flashing product is fixed to the fenestration, liquid moisture is urged outwardly from the front of fenestration product, further protecting the fenestration from moisture. Other moisture control components may be combined with the expandable fenestration flashing product to form an expandable fenestration flashing product system. In addition, the expandable fenestration flashing product may advantageously incorporate features or elements described above for the prefabricated flashing product described above.

Changes may be made in the prefabricated flashing products described herein without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A prefabricated flashing product for an opening having a top, bottom, and two sides in an exterior of a surface of a structure, the flashing product comprising:

a mesh reinforcing member having:

a flange sized and shaped for conforming to the exterior surface around the opening, the flange extending outwardly from an entire perimeter of an aperture therein, the flange having top, bottom, and side flange members, a return having top, bottom and side return members connected respectively to the top, bottom and side flange members, the return extending at an angle from the flange at the aperture within the flange; and a waterproof material covering the entire surface of the reinforcing member to form the flashing product as a monolithic flashing product without joints such that the monolithic flashing product is configured to receive a typical window or door fenestration product.

2. The prefabricated flashing product of claim 1, the reinforcing member comprising a material selected from the group of materials including: plastic, rubber, metal, fabric, paper, or cardboard.

3. The prefabricated flashing product of claim 1, the reinforcing member comprising a slack material and a coating material used to set the slack material in a desired shape.

4. The prefabricated flashing product of claim 3, the coating material being selected from the group of coating materials including glue, adhesive, and curable resin.

5. The prefabricated flashing product of claim 1, the waterproof material being selected from the group of waterproof materials including: plastics, plastic based materials, rubber, rubber based materials, bitumen, asphalt, and asphalt based materials.

6. The prefabricated flashing product of claim 1, the reinforcing member further comprising a return stop.

7. The prefabricated flashing product of claim 1, the reinforcing member further comprising an upper flap attached to the top flange member.

* * * * *